US005257700A

United States Patent [19]

Wallace

[11] Patent Number: 5,257,700

[45] Date of Patent: Nov. 2, 1993

[54] FISHING ROD SUPPORT RACK

[75] Inventor: Eric Wallace, St. Louis, Mo.

[73] Assignee: Lee Rowan Company, St. Louis, Mo.

[21] Appl. No.: 971,518

[22] Filed: Nov. 3, 1992

[51] Int. Cl.[5] ..... A47F 7/00

[52] U.S. Cl. ..... 211/70.8; 211/106

[58] Field of Search ..... 211/60.1, 70.8, 70.6, 211/106, 65

[56] References Cited

U.S. PATENT DOCUMENTS

| | | | |
|---|---|---|---|
| 731,642 | 6/1903 | Wilder | 211/65 |
| 2,452,410 | 10/1948 | Wiegel | 211/60.1 |
| 2,815,863 | 12/1957 | Larson | 211/70.6 X |
| 2,854,147 | 9/1958 | Derr | 211/70.8 |
| 3,421,632 | 1/1969 | Wood | 211/70.8 |
| 3,635,433 | 1/1972 | Anderson | 211/70.8 X |

*Primary Examiner*—Robert W. Gibson, Jr.
*Attorney, Agent, or Firm*—Rogers, Howell & Haferkamp

[57] ABSTRACT

A fishing rod support rack has upper and lower wire frames. The lower frame has a continuous wire hoop, a wire shelf assembly, and a plurality of bent wire loops all welded together. The upper frame has a continuous wire hoop and a plurality of bent wire loops welded together. The upper and lower frames are attached to a wall in such a selectively spaced vertical relation that the loops of the upper frame generally align directly above the loops of the lower frame. The shelf assembly has upper surface portions on which the butt ends of the fishing rods can be removably supported. The loops of the lower frame removably receive the butt ends of the fishing rods therethrough and afterwards engage the grips of the removably supported fishing rods, thereby providing clearance among the removably supported fishing rods. The loops of the upper frame removably receive the tip ends of the fishing rods therethrough and afterwards engage the walls of the removably supported fishing rods, thereby providing the removably supported fishing rods with upright support.

20 Claims, 2 Drawing Sheets

FISHING ROD SUPPORT RACK

BACKGROUND AND SUMMARY OF THE INVENTION

The present invention relates to a fishing rod support rack, and more particularly to a fishing rod support rack for mounting to a wall and for removably supporting a plurality of fishing rods uprightly.

Fishing rod storage racks are well-known in the prior art. The known racks typically support fishing rods in horizontal positions, stacked one on top of another. To do that, the known racks typically comprise a pair of lateral sides that are spaced horizontally apart and that extend vertically between upper and lower edges. Those lateral sides have rear edges for mounting to a wall, and extend forwardly to front edges. The front edges are formed with cradles, coordinated in pairs as between the two lateral sides, and each cradle has surface portions on which fishing rods can be removably supported.

The fishing rod support rack of the present invention is an improvement over the fishing rod storage racks of the prior art. The advantages of the present invention include the advantage that the fishing rods are supported in the upright position. In addition, this fishing rod support rack is made of rather inexpensive small diameter metal wire elements welded together. Furthermore, this fishing rod support rack comprises a pair of independent frames, one upper and the other lower, both of which have a main wire formed in a continuous hoop, with several other subordinate wires welded thereto, the frames gaining manufacturing simplicity therefrom. The continuous hoops of the present invention provide the two frames with the normally incongruous virtues of being strong, lightweight, inexpensive to fabricate and convenient to handle and install by one person. The virtue of being lightweight further results in this fishing rod support rack costing little to ship. It can also be packaged in a compact cardboard box for merchandising, warehousing and handling by a consumer. These and more advantages are provided by the present invention without sacrificing appearance or durability.

In accordance with the present invention, a fishing rod support rack has upper and lower wire frames. The lower frame comprises a continuous wire hoop, a wire shelf assembly welded to the continuous hoop, and a plurality of bent wire loops that are spaced above the shelf assembly and are also welded to the continuous hoop. The continuous hoop is laterally elongated (left to right). It has L-shaped sides that are spaced horizontally apart and that have horizontal and vertical segments joined together at right angles. The continuous hoop further has both an upper rear segment and a lower front segment extending horizontally between the L-shaped sides. The shelf assembly comprises a plurality of parallel wires that extend between and have opposite ends welded to those horizontal segments. The shelf assembly provides upper surface portions on which the butt ends of the fishing rods can be removably supported. The bent wire loops have rear ends welded to the upper rear segment. The bent wire loops further include forward ends that are bent to define openings for removably receiving the butt ends of fishing rods therethrough, and that have surface portions for engaging the grips of the fishing rods. The loops are selectively spaced apart, thereby providing clearance among the removably supported fishing rods for their attached fishing reels.

Turning now to the upper frame, it comprises a continuous wire hoop welded together with a plurality of bent wire loops. The continuous hoop of the upper frame is laterally elongated like the continuous hoop of the lower frame. It has a pair of left and right segments horizontally spaced by upper and lower segments that are several times longer than the left and right segments. The loops of the upper frame have rear ends welded to the upper segment. The loops further include front ends that are bent to define openings for removably receiving the tip ends of fishing rods therethrough, and that have surface portions for removably engaging the walls of the tip ends of fishing rods, thereby providing the fishing rods with support to stand uprightly.

For use, the upper and lower frames can be attached to a wall in such vertically spaced relation that the loops of the upper frame are generally aligned directly above the loops of the lower frame.

BRIEF DESCRIPTION OF THE DRAWINGS

Further objects and features of the present invention are revealed in the following detailed description of the preferred embodiment of the invention and the drawing figures wherein.

DESCRIPTION OF THE PREFERRED EMBODIMENT

Figure 1:
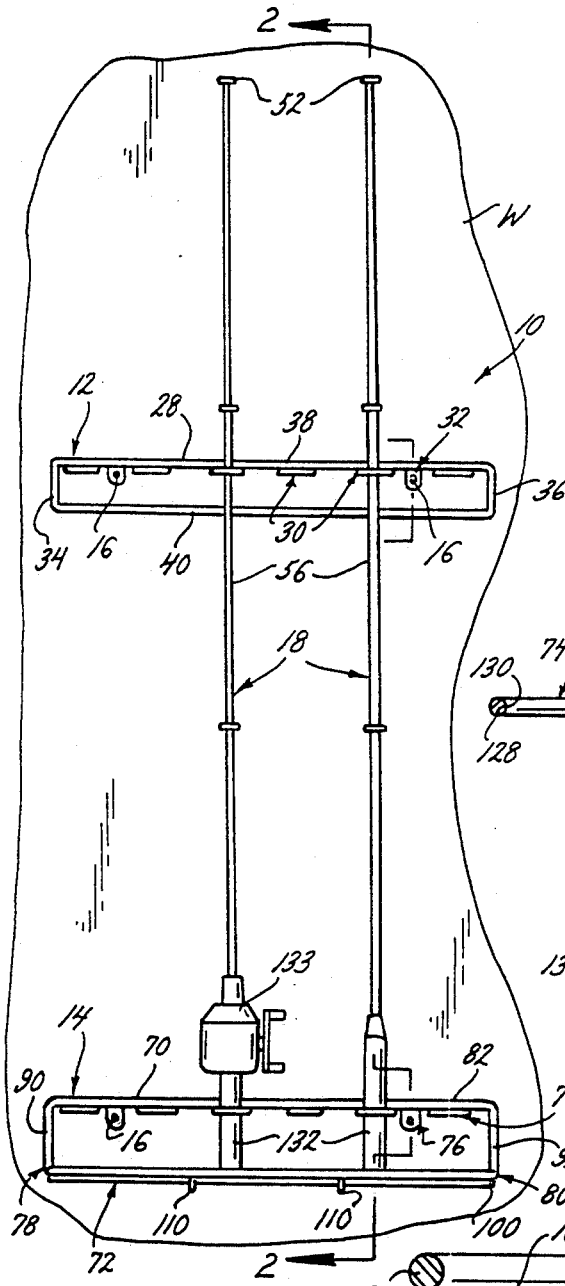
FIG. 1 is a front elevation view of the fishing rod support rack of the present invention, shown mounted to a wall and removably supporting two representative fishing rods uprightly.

As shown in FIG. 1, the fishing rod support rack 10 of the present invention comprises independent upper and lower frames 12 and 14. The upper and lower frames 12 and 14 are shown attached to a wall W, each by a pair of screw fasteners 16. The upper and lower frames 12 and 14 are mounted to the wall W in such a selected vertical relation that the upper and lower frames 12 and 14 cooperate for removably and uprightly supporting a plurality of fishing rods 18, as shown.

Figure 2:
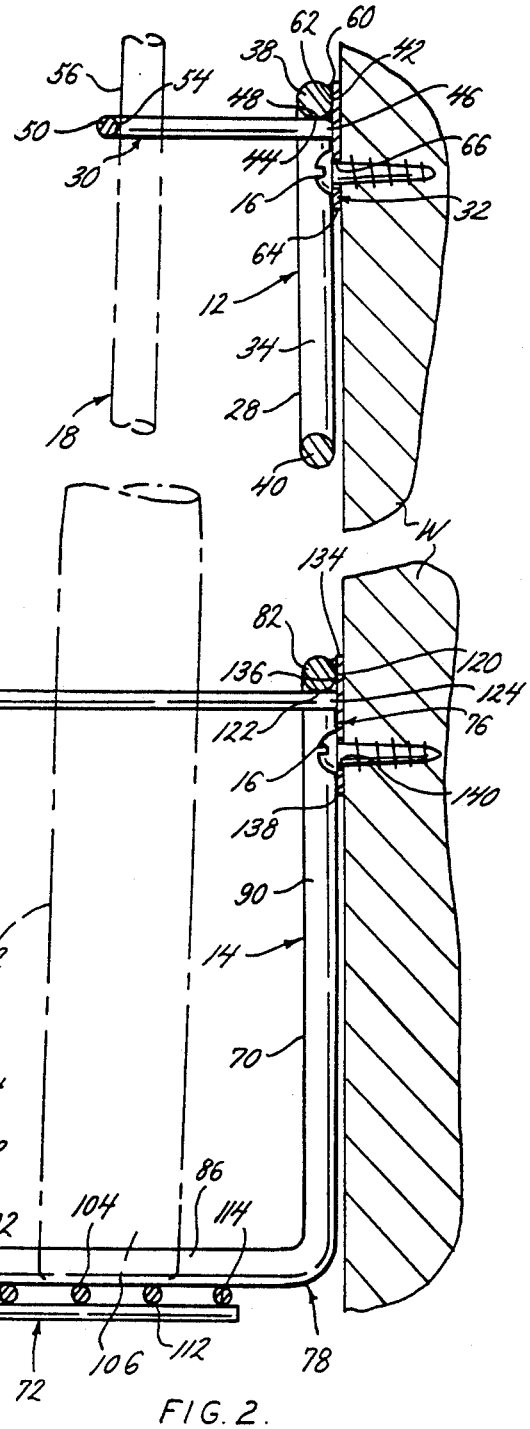
FIG. 2 is an enlarged, partial section view taken along the line 2—2 of FIG. 1.
Figure 3:
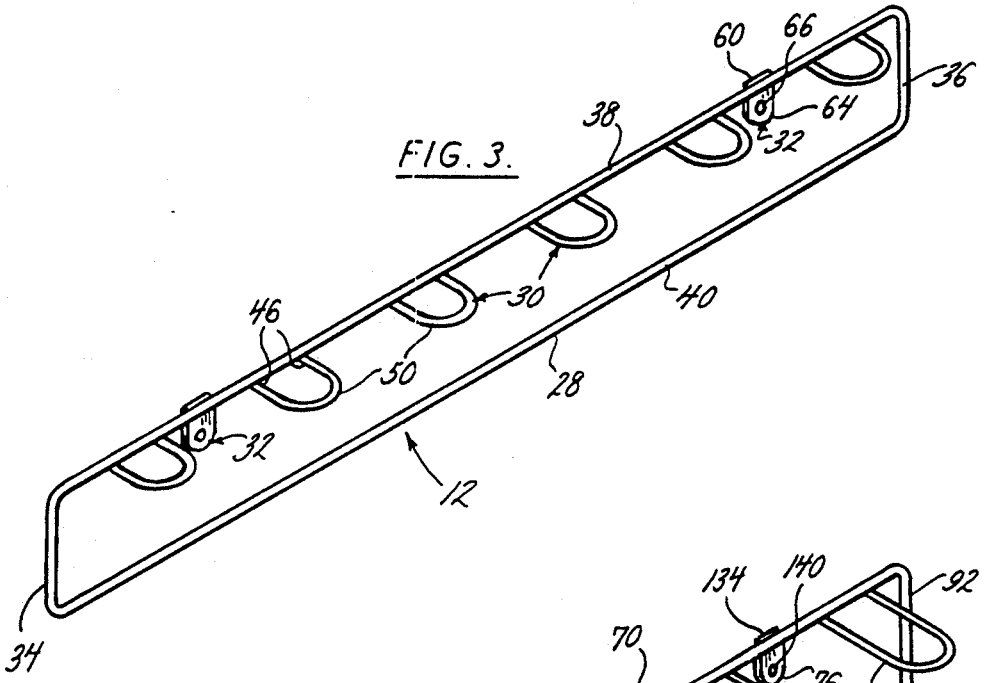
FIG. 3 is a perspective view of the upper frame of the fishing rod support rack of the present invention.

Turning now to FIGS. 1, 2 and 3, the upper frame 12 comprises a continuous wire hoop 28 welded together with a plurality of bent wire loops 30 and a pair of metal tabs 32.

The continuous hoop 28 comprises left and right segments 34 and 36 that are spaced horizontally by upper and lower segments 38 and 40 that are several times longer than the left and right segments 34 and 36. As shown in FIG. 2, the upper segment 38 has rear surface portions 42 to which the tabs 32 are welded, and lower surface portions 44 to which the plurality of loops 30 are welded.

The plurality of loops 30 are generally U-shaped as viewed in a horizontal plane. The U-shaped loops 30 have a pair of rearward ends 46 (see FIG. 2), and have upper surface portions 48 adjacent to the rearward ends 46 for welding to the lower surface portions 44 of the upper segment 38. The U-shaped loops 30 extend forwardly from their rearward ends 46 to forward portions 50 that are bent, as said, in U-shaped loops, consequently defining openings. The openings are sized to permit the removable passage of the tip ends 52 of the fishing rods 18 therethrough, as shown in FIG. 1. In addition, the forward loop portions 50 include surface portions 54 for engaging the walls 56 of the fishing rods 18.

The tabs 32 have upper edges 60, and have forward surface portions 62 adjacent to the upper edges 60 for welding to the rearward surface portions 42 of the upper segment 38. The tabs 32 extend downwardly from their upper edges 60 to lower, distal edges 64. The tabs 32 have holes 66 for receiving the screw fasteners 16 therethrough. The tabs 32 are spaced on the upper segment 38 so as to have about sixteen inches between the centers of the holes 66, corresponding to standard building stud spacing.

The lower segment 40 of the continuous hoop 28 cooperates with the two side segments 34 and 36 to attain a common goal, namely to prevent the upper segment 38 from rotating about its central axis under the cantilever weight of the forwardly projected loops 30.

Figure 4:
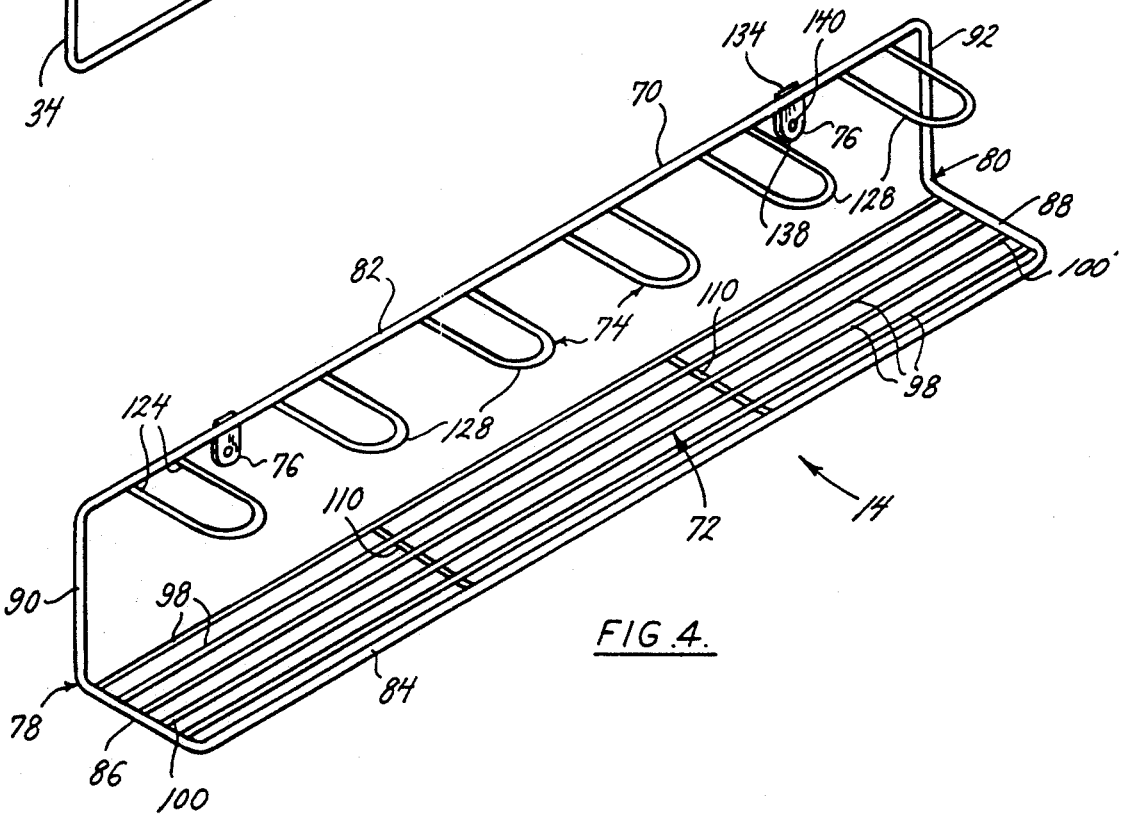
FIG. 4 is a perspective view of the lower frame of the fishing rod support rack of the present invention.

Turning now to FIGS. 1, 2 and 4, the lower frame 14 more particularly comprises a continuous wire hoop 70, a wire shelf assembly 72 welded to the continuous hoop 70, a plurality of bent wire loops 74, and two metal tabs 76 also welded to the continuous hoop 70.

The continuous hoop 70 has left and right, L-shaped sides 78 and 80 spaced horizontally by an upper rear segment 82 and a lower front segment 84. The L-shaped sides 78 and 80 include horizontal segments 86 and 88 that join vertical segments 90 and 92 at right angles. The horizontal segments 86 and 88 have lower surface portions 94 (only left one of which is in view in FIG. 2) to which the shelf assembly 72 is welded.

The shelf assembly 72, comprises a plurality of elongated wires 98 that extend horizontally between opposite ends 100 (see FIGS. 1 and 4). The elongated wires 98 have upper surface portions 102 (see FIGS. 2 and 4) adjacent to the opposite ends 100 for welding to the lower surface portions 94 of the horizontal segments 86 and 88. The plurality of elongated wires 98 are provided with additional upper surface portions 104 (see FIGS. 2 and 4) on which the butt ends 106 of fishing rods 18 can be removably supported, as shown in FIGS. 1 and 2.

The plurality of elongated wires 98 are generally parallel to one another and evenly spaced apart. Their opposite ends 100 are generally welded to the horizontal segments 86 and 88 at regularly spaced intervals, as shown. This parallel relation between the elongated wires 98 is stabilized at two locations between their opposite ends 100 by a pair of wire stabilizers 110. The stabilizers 110 extend in the direction that is perpendicular to the axially extending direction of the elongated wires 98. The elongated wires 98 have lower surface portions 112 and the stabilizers 110 have upper surface portions 114 mutually permitting welded engagement therebetween (See FIG. 2).

The continuous hoop 70 is generally provided with surface portions on the upper rear segment 82 for welding engagements with the loops 74 and tabs 76 of the lower frame 14. That is, as shown in FIG. 2, the upper rear segment 82 has rearward surface portions 120 for welds with the tabs 76, and also has lower surface portions 122 for welds with the loops 74.

The loops 74 are generally U-shaped as viewed in a horizontal plane. More particularly, the loops 74 have rearward ends 124 (see FIG. 2), and have upper surface portions 126 adjacent to the rearward ends 124 for welding to the lower surface portions 122 of the upper, rear segment 82. The loops 74 extend forwardly from their rearward ends 124 to forward loop portions 128 that are bent, as said, into U-shapes. The forward loop portions 128 define openings for receiving the butt ends 106 of the fishing rods 18 therethrough. In addition, the forward loop portions 128 have surface portions 130 for engaging the grips 132 of the removably supported fishing rods 18. Since the plurality of loops 74 are selectively spaced apart, they thereby provide clearance among the removably supported fishing rods 18 for the attached fishing reels 133 (see FIG. 1).

The tabs 76 have an upper edge 134, and have forward surface portions 136 adjacent to the upper edge 134 for welding to the rearward surface portions 120 of the upper, rear segment 82. The tabs 76 extend downwardly from the upper edges 134 to lower distal edges 138. The tabs 76 have holes 140 for receiving the screw fasteners 16 therethrough. The tabs 76 are horizontally spaced on the upper, rear segment 82 of the continuous hoop 70 to have about 16 inches between the centers of the holes 140.

Prior to use, the upper and lower frames 12 and 14 of the fishing rod support rack 10 would be attached to the wall W in a selectively spaced, vertical relation, preferably with the tabs 32 and 76 overlying building studs. In any event, the plurality of loops 30 of the upper frame 12 would be generally aligned directly above the plurality of loops 74 of the lower frame 14, as shown.

In use, a fishing rod 18 easily can be removably and uprightly supported on the fishing rod support rack 10. To begin, the tip end 52 of the fishing rod 18 would be passed through a selected loop 30 of the upper frame 12 from below. Next, the fishing rod 18 would be advanced through the selected loop 30 of the upper frame 12 until the butt end 106 would be positioned in an elevation higher than the certain loop 74 of the lower frame 14 directly below the selected loop 30 of the upper frame 12. Then, the butt end 106 of the fishing rod 18 would be lowered through the loop 74 of the lower frame 14, until the butt end 106 would engage and rest upon the upper surface portions 104 of the shelf assembly 72. Thereafter, the surface portions 130 of the loop 74 of the lower frame 14 would serve to engage the grips 132 of the removably supported fishing rod 18, thereby providing clearance on the shelf assembly 72 among all the removably supported fishing rods 18 for their attached fishing reels 133 (see FIG. 1). Furthermore, the surface portions 54 of the selected loop 30 of the upper frame 12 would serve to engage the walls 56 of the removably supported fishing rod 18, thereby providing the upright support thereof. Fishing rods of various lengths can be supported on the rack 10.

This fishing rod support rack 10 is particularly suitable not only for retail use in the retailing of inexpensive household conveniences, but also for residential use, such as installation in a garage or basement.

Preferably, the upper and lower frames 12 and 14 are wide enough (left to right) for supporting a sufficient number of loops for a household's fishing rod needs; for example, both the upper and lower frames 12 and 14 can be 24½ inches wide for supporting six upper loops 30 and six corresponding lower loops 74. The loops 30 and 74 are sufficiently spaced apart, such as about 4 inches between the central axes (front to back) of adjacent loops 30 or 74. Such spacing among the loops 30 or 74 provides clearance among the removably supported fishing rods 18 for their attached reels 133.

Additionally, this fishing rod support rack 10 is made of rather inexpensive, small diameter metal wire elements, inexpensively fixed together by means of welded joints. More particularly, the continuous hoops 28 and 70 each can be of about 0.243 inch diameter wire, the U-shaped loops 30 and 74 each of about 0.120 inch diameter wire, the elongated wires 98 of the shelf assembly 72 each of about 0.135 diameter wire, and the wire stabilizers 110 each of about 0.135 diameter wire.

For manufacturing efficiency, the loops 30 of the upper frame 12 and the loops 74 of the lower frame 14 can have the same bending radius for their U-shaped, forward loop portions 50 and 128, respectively, such as about a $\frac{7}{8}$ inch bending radius for the outside of the bends, so that the loops 30 and 74 are about $1\frac{3}{4}$ inches wide (left to right).

The upper frame 12 nests within the lower frame 14 for compact packaging of this fishing rod support rack 10. To do that, the loops 30 of the upper frame 12 are shorter (front to rear) than the loops 74 of the upper frame 14, such as the loops 30 being about $1\frac{5}{8}$ inches long while the loops 74 are about 2 29/32 inches long. Furthermore, the continuous hoop 28 of the upper frame 12 is short enough (top to bottom) to fit between the shelf assembly 72 and the loops 74 of the lower frame 14. Thus the continuous hoop 28 of the upper frame 12 can be about $2\frac{5}{8}$ inches tall (top to bottom), while the vertical segments 90 and 92 of the continuous hoop 70 of the lower frame 14 are about 4 inches tall. And still further, the horizontal segments 86 and 88 of the continuous hoop 70 of the lower frame 14 are preferably longer (front to rear) than the loops 30 of the upper frame 12, such as the horizontal segments 86 and 88 being about $3\frac{1}{4}$ inches long while the loops 30 are about $1\frac{5}{8}$ inches long. And so, the upper rack 12 can generally nest in the lower rack 14. This general nestability permits more compact packaging of the fishing rod support rack 10, and thus saves shipping costs and permits a greater number of the racks 10 to be stocked in inventory and displayed on store shelves.

For manufacturing simplicity, the upper frame 12 is fabricated by having each of the loops 30 and each of the tabs 32 welded to just one element, the continuous hoop 28. Likewise, for the lower frame 14, each of the loops 74, each of the tabs 76, and each of the elongated wires 98 of the shelf assembly 72 are welded to just one element, the continuous hoop 70. An exception is that the stabilizer wires 110 of the lower frame 14 are welded to the elongated wires 98 in addition to being welded to the lower front segment 84 of the continuous hoop 70 (see FIG. 2).

The elongated wires 98 of the shelf assembly 72 are sufficiently spaced apart for saving weight, provided that they are not spaced so far apart that the butt ends 106 of fishing rods 18 can fall therebetween. About $\frac{1}{2}$ inch between longitudinal axes is suitable.

For the foregoing reasons, the fishing rod support rack 10 is strong, lightweight, and inexpensive to fabricate, as well as being convenient to handle and install by one person.

While the present invention has been described by reference to a specific embodiment, it should be understood that modifications and variations of the invention may be constructed without departing from the scope of the invention defined in the following claims.

What is claimed is:

1. A fishing rod support rack comprising:

lower and upper units;

the lower unit comprising a shelf and side rail assembly having a pair of elongated side members horizontally spaced by and securely supporting a plurality of elongated cross members, said cross members being spaced apart from one another in a generally parallel relation and having surface portions upon which the butt ends of fishing rods can be removably supported, first means spaced above the shelf and side rail assembly for removably engaging the grips of the removably supported fishing rods, thereby providing clearance among the removably supported fishing rods, and second means for attaching to a front of a mounting structure and for securely supporting the shelf and side rail assembly and the first means;

the upper unit comprising third means for removably engaging the walls of the removably supported fishing rods, thereby providing the removably supported fishing rods with support to stand uprightly, and fourth means for attaching to the front of the mounting structure in vertically spaced coordination with the lower unit and for securely supporting the third means.

2. The fishing rod support rack of claim 1 wherein:

the side members are metal wire segments, and the cross members are metal wire segments welded to the side members.

3. The fishing rod support rack of claim 2 wherein:

the side members are segments of a continuous wire.

4. The fishing rod support rack of claim 1 wherein:

the first means comprises a plurality of U-shaped metal wires.

5. The fishing rod support rack of claim 4 wherein:

the side members are segments of a continuous metal wire, and the second means comprise other segments of the same continuous wire.

6. The fishing rod support rack of claim 5 wherein:

the U-shaped wires are welded to the continuous wire.

7. A fishing rod support rack comprising:

lower and upper units;

the lower unit comprising a continuous hoop of an elongated element for attaching to a front of a mounting structure, first means securely supported by the continuous hoop providing upper surface portions on which the butt ends of fishing rods can be removably supported, and second means spaced above the first means and securely supported by the continuous hoop for removably engaging the grips of the removably supported fishing rods, thereby providing clearance among the removably supported fishing rods;

the upper unit comprising third means for removably engaging the walls of the removably supported fishing rods, thereby providing the removably supported fishing rods with support to stand uprightly, and fourth means for attaching to the front of the mounting structure in vertically spaced coordination with the lower unit and for securely supporting the third means.

8. The fishing rod support rack of claim 7 wherein:

the continuous hoop has L-shaped side members horizontally spaced by an upper, rear and a lower, front cross member.

9. The fishing rod support rack of claim 8 wherein:

each L-shaped side member includes a horizontal segment, and the first means comprises a plurality of elongated members extending horizontally between and having opposite ends joined to the horizontal segments; said plurality of elongated members being generally spaced parallel to one another.

10. The fishing rod support rack of claim 9 wherein:

the continuous hoop is a continuous metal wire, and the plurality of elongated members are metal wires that are welded to the horizontal segments of the L-shaped sides of the continuous wire.

11. The fishing rod support rack of claim 10 wherein:

the second means comprises a plurality of bent metal wires that have rearward ends welded to the upper, rear cross member of the continuous wire.

12. The fishing rod support rack of claim 11 wherein:

the plurality of bent metal wires extend forwardly from the rearward ends to forward portions bent to form loops that have openings; the openings permitting the removable passage of the butt ends of fishing rods therethrough.

13. The fishing rod support rack of claim 7 wherein:

the fourth means comprises a continuous hoop of metal wire; and the third means comprises a plurality of bent metal wires that have rearward ends welded to the continuous hoop of the upper unit, and that project forwardly from the rearward ends to bending portions shaped for engaging the walls of the removably supported fishing rods.

14. The fishing rod support rack of claim 13 wherein:

the bending portions form loops that define openings that are sized to permit the removable passage of the tip ends of the fishing rods therethrough.

15. A fishing rod support rack comprising:

upper and lower frames;

the lower frame comprising a shelf assembly that has surface portions on which the butt ends of fishing rods can be removably supported;

a plurality of retainers spaced above the shelf assembly for removably engaging the grips of the removably supported fishing rods, thereby providing clearance among the removably supported fishing rods;

a first continuous hoop of an elongated element for attaching to a front of a mounting structure and for securely supporting the shelf assembly and retainers in fixed relations;

the upper frame comprising a plurality of retainers for removably engaging the walls of the removably supported fishing rods, thereby providing the removably supported fishing rods with support to stand uprightly; and a second continuous hoop of an elongated element for attaching to the front of the mounting structure in vertically spaced coordination with the lower frame and for securely supporting the retainers of the upper frame.

16. The fishing rod support rack of claim 15 wherein:

the first continuous hoop of an elongated element is a single metal wire.

17. The fishing rod support rack of claim 16 wherein:

the first continuous hoop has L-shaped side members horizontally spaced by an upper, rear and a lower, front cross member.

18. The fishing rod support rack of claim 17 wherein:

each L-shaped side member includes a horizontal segment; and the shelf assembly comprises a plurality of metal wire elements extending horizontally between and having opposite ends welded to the horizontal segments; said plurality of metal wire segments being spaced generally parallel to one another.

19. The fishing rod support rack of claim 17 wherein:

said retainers of the lower unit are bent metal wires that have rearward ends welded to the upper, rear cross member, and that project forwardly to forward portions that define openings that are sized to permit the removable passage of the butt ends of the fishing rods therethrough.

20. The fishing rod support rack of claim 15 wherein:

the second continuous hoop of an elongated element is a continuous metal wire; and said retainers of the upper unit are bent metal wires that have rearward ends welded to the second continuous hoop, and that project forwardly to forward portions that define openings that are sized to permit the removable passage of the tips of the fishing rods therethrough.

* * * * *